US006659796B1

(12) United States Patent
Waddell et al.

(10) Patent No.: US 6,659,796 B1
(45) Date of Patent: Dec. 9, 2003

(54) MULTI-FUNCTION MOUNTING/LATCH COMPONENT FOR ELECTRICAL CONNECTORS

(75) Inventors: Kent D. Waddell, Ennis (IE); Denise Brennan, Limerick (IE); Eugene Folan, Galway (IE); John M. Horgan, Limerick (IE); Enda Kelly, Kilshanny (IE); Joseph McCarthy, Cappamore (IE); Brian Murphy, Mungret (IE); John Wallace, Racefield (IE); Jay H. Neer, Boca Raton, FL (US); John Meaney, Ennis (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/177,511

(22) Filed: Jun. 21, 2002

(51) Int. Cl.[7] ..... H01R 13/73

(52) U.S. Cl. ..... 439/557; 439/544; 439/79; 439/352; 439/557

(58) Field of Search ..... 439/362, 352, 439/357, 358, 544, 552, 553, 557, 562, 563, 564, 565, 567, 569, 571, 573, 79, 76.1, 607

(56) References Cited

U.S. PATENT DOCUMENTS

| | | | | | |
|---|---|---|---|---|---|
| 4,743,210 | A | | 5/1988 | Schild et al. | 439/559 |
| 4,808,125 | A | | 2/1989 | Waters et al. | 439/607 |
| 4,812,133 | A | | 3/1989 | Fleak et al. | 439/248 |
| 4,822,303 | A | | 4/1989 | Nakamura et al. | 439/607 |
| 4,854,890 | A | | 8/1989 | Nishimura | 439/607 |
| 4,906,208 | A | | 3/1990 | Nakamura et al. | 439/607 |
| 4,911,659 | A | * | 3/1990 | Viselli | 439/570 |
| 5,037,325 | A | | 8/1991 | Wirkus | 439/467 |
| 5,037,331 | A | | 8/1991 | Goodman et al. | 439/607 |
| 5,044,985 | A | * | 9/1991 | Sheen | 439/544 |
| 5,174,789 | A | | 12/1992 | Yu et al. | 439/607 |
| 5,288,244 | A | * | 2/1994 | Lien | 439/362 |
| 5,527,991 | A | | 6/1996 | Sadowski et al. | 174/51 |
| 5,669,731 | A | | 9/1997 | Hironaka et al. | 403/405 |
| 5,752,854 | A | | 5/1998 | Capp et al. | 439/607 |
| 6,017,233 | A | | 1/2000 | Fry et al. | 439/248 |
| 6,126,485 | A | * | 10/2000 | Shobara et al. | 439/607 |
| 6,443,768 | B1 | * | 9/2002 | Dirkers et al. | 439/607 |

* cited by examiner

*Primary Examiner*—Tho D. Ta
(74) *Attorney, Agent, or Firm*—Stephen Z. Weiss

(57) ABSTRACT

An electrical connector assembly is provided for mounting to a first side of a panel and through an opening in the panel. A connector housing is adapted for mounting through the opening in the panel and carries a plurality of terminals. A multi-function mounting/latch component includes at least one mounting boss for mounting the connector housing on a circuit board. The multi-function component includes at least one mounting aperture for receiving a mounting post of the connector housing for mounting the connector housing at the first side of the panel and through the opening in the panel. The multi-function component includes at least one latch arm projecting through the opening to a second side of the panel. A locking plate is engageable with the latch arm at the second side of the panel to hold the connector in assembly through the panel. The latch arm includes a latching aperture to facilitate latching the connector assembly to a complementary mating connector at the second side of the panel.

28 Claims, 3 Drawing Sheets

MULTI-FUNCTION MOUNTING/LATCH COMPONENT FOR ELECTRICAL CONNECTORS

FIELD OF THE INVENTION

This invention generally relates to the art of electrical connectors and, particularly, to an electrical connector assembly for mounting to a panel through an opening in the panel where the other end of the connector is mountable on a printed circuit board.

BACKGROUND OF THE INVENTION

A typical electrical connector includes some form of insulating or dielectric housing mounting a plurality of terminals. The connector may be used in a wide range of electrical connection environments. For instance, the connector may be mounted on a printed circuit board for electrical connection to circuit traces on the board. The connector may be mounted to and through an opening in a panel from one side of the panel for mating with a complementary mating connector on an opposite side of the panel.

With such applications as described above, some form of mounting means typically must be provided for mounting the connector to the printed circuit board. Additional mounting means typically must be provided for mounting the connector through the opening in the panel. Still additional latching means must be provided on the connector for engagement by fasteners or other latches to hold the connector in the opening in the panel. Yet further latching means may be provided for latching the connector to the complementary mating connector. All of these functions and various mounting and/or latching means typically are separate components and unduly complicate the manufacturability and assembly of the connector. The present invention is directed to solving those problems by providing a unique multi-function mounting/latch component which performs a first function of mounting the connector to a printed circuit board, a second function of mounting the connector to the multi-function component, a third function of facilitating latching the connector in position in the panel and a fourth function of latching the connector to a mating connector.

SUMMARY OF THE INVENTION

An object, therefore, of the invention is to provide a new and improved electrical connector assembly which includes a multi-function mounting/latch component which is effective to eliminate multiple components typically required in prior art connectors of the character described.

In the exemplary embodiment of the invention, a connector housing is adapted for mounting through an opening in a panel from a first side thereof, the housing carrying a plurality of conductive terminals. A multi-function mounting/latch component includes first means for mounting the connector housing on a circuit board, second means for mounting the connector housing at the first side of the panel to the multi-function component and through the opening in the panel, and third means extending through the opening to a second side of the panel. Locking means are engageable with the third means at the second side of the panel to hold the connector assembly to the panel. The component includes a means for latching the connector to a mating connector at the second side of the panel.

According to one aspect of the invention, the first means is provided by at least one mounting boss on the multi-function component. The mounting boss receives an appropriate fastener for securing the multi-function component to the circuit board.

According to another aspect of the invention, the second means includes at least one mounting post on one of the housing or the multi-function component insertable into a mounting aperture in the other of the housing or multi-function component. As disclosed herein, the second means includes a plurality of the mounting posts on the housing insertable into a corresponding plurality of mounting apertures in the multi-function component.

According to a further aspect of the invention, the third means includes a latch arm projecting from the multi-function component through the panel. The locking means is engageable with the latch arm. The latch arm includes a plurality of latching serrations engageable by the latch means to accommodate panels of varying thicknesses. As disclosed herein, the multi-function component is elongated and includes a pair of the latch arms at opposite ends thereof. The locking means is provided by a thin locking plate snappingly engageable with the serrations of the latch arms. The latch arms include the fourth means for latching to the mating connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
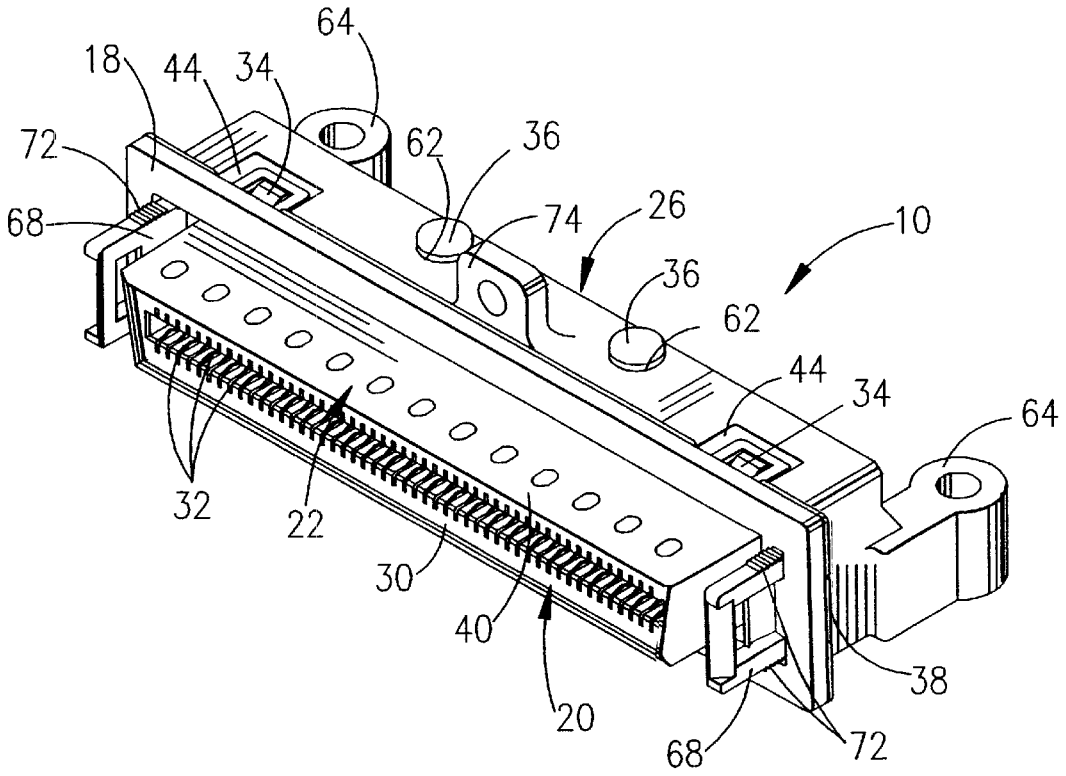
FIG. 1 is perspective view of an electrical connector assembly embodying the concepts of the invention.
Figures 2, 7:
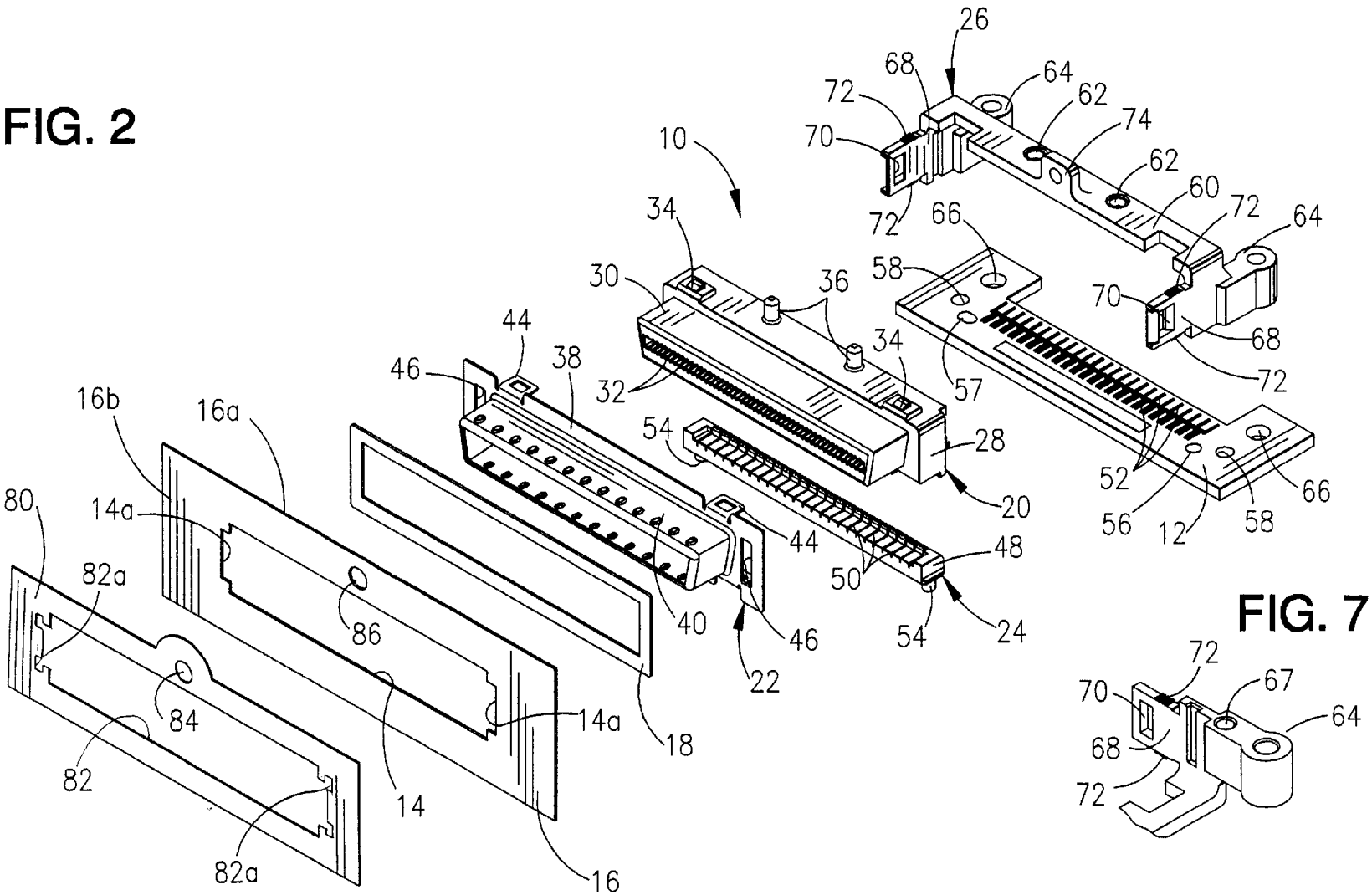
FIG. 2 is an exploded perspective view of the connector assembly in conjunction with a circuit board and a panel through which the assembly is mounted.
FIG. 7 is an enlarged, fragmented perspective view of the bottom of one end of the multi-function mounting/latch component of the connector assembly.

Referring to the drawings in greater detail, and first to FIGS. 1 and 2, a first embodiment of an electrical connector assembly, generally designated 10, is shown for mounting on a circuit board 12 (FIG. 2) and through an opening 14 in a panel 16. FIG. 2 also shows an electromagnetic gasket 18 which may be provided between the connector assembly and a rear or first side 16*a* of panel 16 when the connector is mounted through opening 14 in the panel.

Generally, electrical connector assembly 10 includes an insulating or dielectric connector housing, generally designated 20; a metal shield, generally designated 22 which is positionable over the front of the housing; a terminal tail aligner, generally designated 24; and a multi-function mounting/latch component, generally designated 26, which facilitates both mounting the connector assembly to circuit board 12 as well as through opening 14 in panel 16 and can latchingly engage a mating connector.

More particularly, connector housing 20 of connector assembly 10 includes a main body portion 28 (FIG. 2) and a forwardly projecting mating portion 30. The housing mounts a plurality of rows of conductive terminals which include terminal contacts 32 projecting forwardly into mating portion 30 for engaging the contacts of an appropriate complementary mating connector. The housing 20 may be unitarily molded of plastic material or the like, and a pair of snap-latch bosses 34 are formed on both the top and bottom of the housing. In addition, a pair of mounting posts 36 project upwardly from body 28 of the housing.

Shield 22 of connector assembly 10 may be deep drawn of sheet metal material. The shield includes a plate portion 38 for abutting against the front face of body 28 of housing 20, as well as a shroud portion 40 which surrounds mating portion 30 of the housing. The shield has a pair of snap-latches 44 projecting rearwardly from the top and bottom edges of plate portion 38 for engaging snap-latch bosses 34 of connector housing 20 to hold the shield in assembly on the housing as seen in FIG. 1. Lastly, the shield has a pair of vertically elongated slots 46 formed in plate portion 38 at opposite ends of shroud portion 40, for purposes described hereinafter.

Tail aligner 24 of connector assembly 10 may be molded of dielectric material such as plastic or the like and includes an elongated body portion 48. A plurality of passages 50 are formed through the body portion and through which tail portions of the terminals mounted within housing 20 extend for connection to circuit traces 52 (FIG. 2) on circuit board 12. A pair of mounting posts 54 project downwardly at opposite ends of the tail aligner for insertion into mounting hole 56 and enlongated mounting hole 57 in the circuit board.

Multi-function mounting/latch component 26 is a unique component in that it performs multiple functions and replaces multiple components of prior art connector assemblies. In particular, multi-function component 26 is a one-piece structure which may be fabricated of die-cast metal or the like. The multi-function component includes a transverse body 60 having a pair of mounting apertures 62 for receiving mounts posts 36 of connector body 20. A pair of generally cylindrical mounting bosses 64 project rearwardly at opposite ends of body 60. The mounting bosses are provided for receiving appropriate fasteners (not shown) which extend through the cylindrical bosses and into a pair of mounting holes 66 in circuit board 12. As shown in FIG. 7, cylinder recesses 67 are provided for receiving second fasteners (not shown). The second fasteners extend through second mounting hole 58 in circuit board 12 and grip in the cylindrical recesses 67. A pair of latch arms 68 project forwardly at opposite ends of body 60 and have apertures 70 therethrough near forward distal ends of the latch arms. As best seen in FIG. 1, the upper and lower edges of latch arms 68 are provided with serrations 72 for purposes described hereinafter. Lastly, an apertured locking boss 74 projects upwardly from body 60, generally at the center thereof, also for purposes to be described hereinafter.

FIG. 1 shows connector housing 20, shield 22 and multi-function component 26 in assembled condition, in conjunction with electromagnetic gasket 18. When so assembled, the connector housing is substantially surrounded by the metal shield and the die-cast metal multi-function component. Therefore, the connector housing is hardly visible in FIG. 1.

When assembled as shown in FIG. 1, shield 22 is assembled over connector housing 20 with shroud portion 40 of the shield surrounding mating portion 30 of the housing. When fully assembled, snap latches 44 of the shield latchingly engage with snap-latch bosses 34 of the housing. Multi-function component 26 is assembled over body 28 of the connector housing in a forward linear direction by inserting latch arms 68 of the multi-component through slots 46 (FIG. 2) in plate portion 38 of the shield. During assembly, the multi-function component preferably is assembled to the housing first and then this subassembly is assembled to the shield. In that way, mounting posts 36 of the housing can be inserted into mounting apertures 62 of the multi-function component either by a press-fit or by swaging the posts once they are inserted through the apertures. Tail aligner 24 can be positioned over the terminal tails and the connector assembly can be mounted to circuit board 12 by appropriate fasteners extending through mounting bosses 64 of the multi-function component and into mounting holes 66 in the circuit board and through mounting hole 58 into cylindrical recess 67 in the mounting boss 64.

Figure 3:
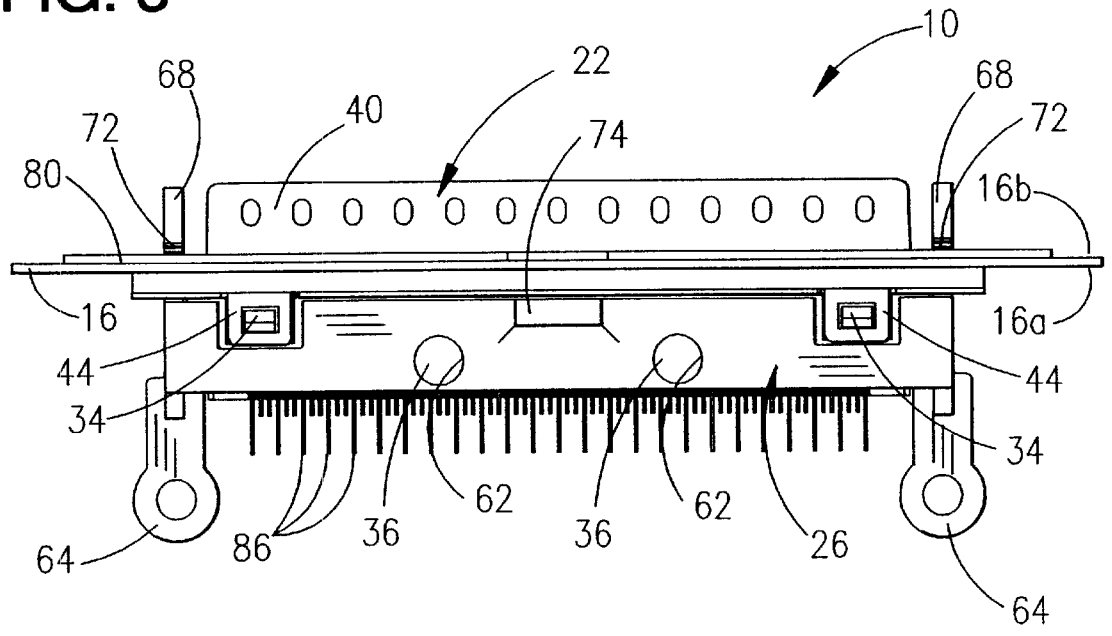
FIG. 3 is a top plan view of the connector assembly mounted through the panel but without the circuit board.
Figure 4:
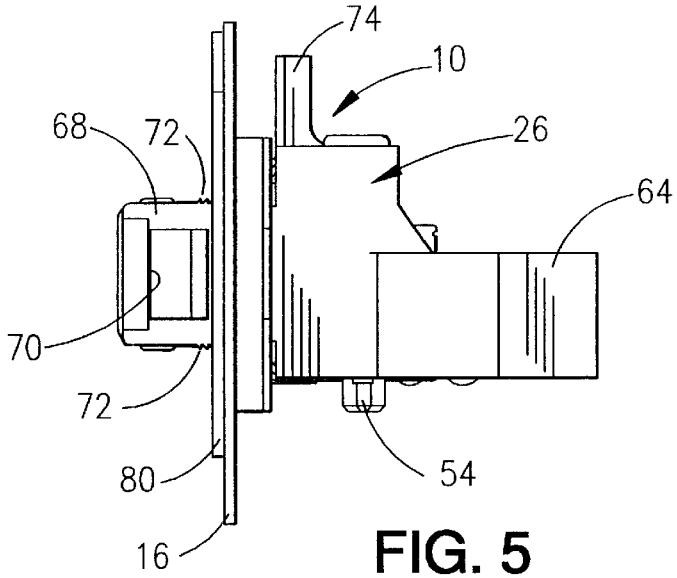
FIG. 4 is an end elevational view of the connector assembly mounted through the panel.
Figure 5:
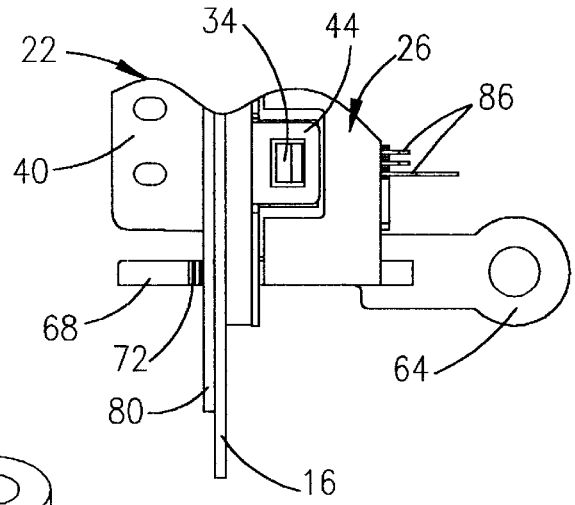
FIG. 5 is an enlarged, fragmented plan view of one end of the connector assembly mounted through the panel.

The connector assembly 10 can be mounted through opening 14 in panel 16 before mounting the assembly to circuit board 12. With this scenario, reference is made to FIGS. 3–5 which show the connector assembly mounted through opening 14 (FIG. 2) in panel 16. In essence, mating portion 30 of connector housing 20 and surrounding shroud portion 40 of shield 22 extend through the opening in the panel. In addition, latch arms 68 which extend through slots 46 (FIG. 2) in the shield, extend through cutouts 14*a* (FIG. 2) at opposite ends of opening 14 in the panel. Therefore, as seen in FIGS. 3–5, the majority of electrical connector assembly 10 is located on first side 16*a* of panel 16, while the mating portion of the connector housing surrounded by shroud portion 40 of the shield, along with latch arms 68 of multi-function component 26, project through the panel to a second or opposite side 16b thereof.

In order to lock the connector assembly in position mounted through opening 14 in panel 16, a rigid latch in the form of a thin metal latching plate 80 (FIGS. 2–5) is positioned over shroud portion 40 of shield 22 and latch arms 68 of multi-function component 26. FIG. 2 shows that latching plate 80 has an elongated opening 82 for surrounding these components. The elongated opening has top and bottom elongated edges 82*a*. According to the invention, the width of the elongated opening is such that top and bottom elongated edges 82*a* engage serrations 72 at the top and bottom of latch arms 68 of multi-component 26. With the latching plate being fabricated of rigid material, the top and bottom edges snappingly engage serrations 72. By using serrations, the latch means can accommodate panels of varying thicknesses. If it is desired to solidly lock the entire assembly in position through panel 16, latching plate 80 has a hole 84 and panel 16 has a hole 86 through which a fastener, such as a bolt, can be inserted into apertured boss 74 of multi-component 26 to completely lock the connector assembly mounted to and through the panel.

As stated above, circuit board 12 can be mounted to multi-function component 26 either before or after the component mounts connector assembly 10 to and through panel 16. FIGS. 3–5 illustrate that the circuit board is to be mounted after the connector assembly is mounted to and through the panel. However, FIG. 3 shows tail portions 86 of the connector terminals in position for connection to circuit traces 52 of the circuit board.

Figure 6:
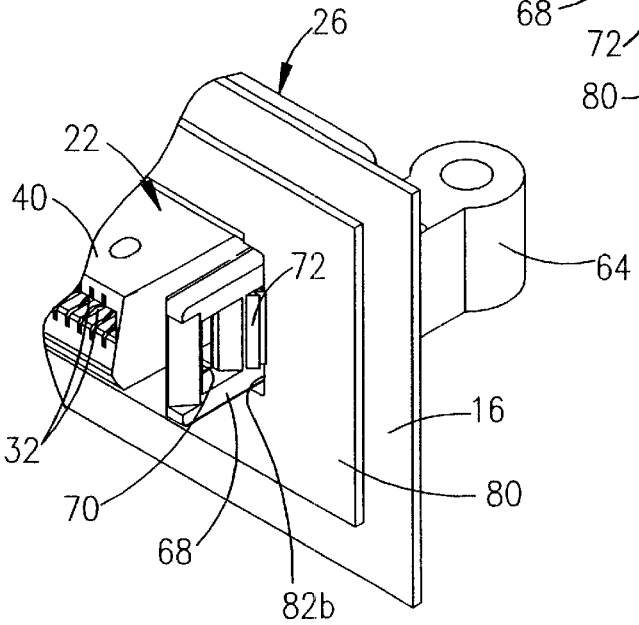
FIG. 6 is an enlarged, fragmented perspective view of one end of an alternate embodiment of the invention, with the connector assembly mounted through a panel.

FIG. 6 shows an alternate embodiment of the invention wherein serrations 72 are formed on the outside surfaces of latch arms 68 of multi-function component 26, rather than on the top and bottom edges of the latch arms as in the first embodiment of FIGS. 1–5. These serrations engage opposite end edges 82*b* of opening 82 in locking plate 80. Otherwise, the connector assembly is substantially identical to that described above and, consequently, like reference numerals have been applied in FIG. 6 corresponding to like components described above in relation to the first embodiment of FIGS. 1–5.

From the foregoing, it can be seen that multi-function component 26 performs a plurality of functions. The component includes first means in the form of mounting bosses 64 and cylindrical recesses 67 for securing the connector assembly to circuit board 12. The component includes second means in the form of mounting apertures 62 cooperating with mounting posts 36 of the connector housing for mounting the housing at one side of panel 16 and through opening 14 in the panel. The component includes third means in the form of latch arms 68 which extend through the opening in the panel for engagement by latch means in the form of locking plate 80 to lock the entire connector assembly to and through the panel. Finally, multi-function component 26 includes fourth means in the form of apertures 70 in latch arms 68 for engaging appropriate latches on a complementary mating connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly for mounting to a first side of a panel and through an opening in the panel, comprising:

a connector housing, a portion of which mounts through the opening in the panel, and carrying a plurality of terminals;

a multi-function mounting/latch component having first means for mounting the connector housing on a circuit board, second means for mounting the connector housing to said multi-function component at said first side of the panel; and third means for mounting the connector assembly to the panel extending through the opening to a second side of the panel comprising a latch arm projecting from the multi-function component through the opening and engageable with means for locking at said second side of the panel to hold the connector assembly to the panel.

2. The electrical connector assembly of claim 1 wherein said first means for mounting comprise at least one mounting boss for receiving a appropriate fastener for securing the connector assembly to the circuit board.

3. The electrical connector assembly of claim 1 wherein said latch arm includes a plurality of latching serrations engageable by said means for locking to accommodate panels of varying thicknesses.

4. The electrical connector assembly of claim 1 wherein said multi-function component is elongated and includes a pair of said latch arms at opposite ends thereof.

5. The electrical connector assembly of claim 1 wherein said second means for mounting comprise at least one mounting post on the housing insertable into a mounting aperture in the multi-function component.

6. The electrical connector assembly of claim 5 wherein said second means comprise a plurality of said mounting posts on the housing insertable into a corresponding plurality of mounting apertures in the multi-function component.

7. The electrical connector assembly of claim 1 wherein said latch means include a thin locking plate engageable with the latch arm.

8. The electrical connector assembly of claim 7 wherein said latch arm includes a plurality of latching serrations engageable by edges of said latching plate.

9. The electrical connector assembly of claim 8 wherein said multi-function component is elongated and includes a pair of said latch arms at opposite ends thereof.

10. The electrical connector assembly of claim 1 wherein said third means for mounting include means for latching the connector assembly to a complementary mating connector at said second side of the panel.

11. The electrical connector assembly of claim 10 wherein said third means for mounting comprise a latch arm projecting from the multi-function component through the panel, said means for locking being engageable with the latch arm, and said means for latching comprising a latching aperture through the latch arm.

12. An electrical connector assembly for mounting to a first side of a panel and through an opening in the panel, comprising;

a connector housing adapted for mounting through the opening in the panel and carrying a plurality of terminals;

a multi-function mounting/latch component having first means for mounting the connector housing on a circuit board, second means for mounting the connector housing to the multi-function component, and third means for mounting extending through the opening to a second side of the panel, the third means comprising a latch arm projecting from the multi-function component through the panel; and means for locking the connector assembly to the panel engageable with said latch arm at said second side of the panel to hold the connector assembly to the panel.

13. The electrical connector assembly of claim 12 wherein said first means comprise at least one mounting boss for receiving an appropriate fastener for securing the connector assembly to the circuit board.

14. The electrical connector assembly of claim 12 wherein said latch arm includes a plurality of latching serrations engageable by said latch means to accommodate panels of varying thicknesses.

15. The electrical connector assembly of claim 12 wherein said multi-function component is elongated and includes a pair of said latch arms at opposite ends thereof.

16. The electrical connector assembly of claim 12 wherein said latch means include a thin locking plate engageable with the latch arm.

17. The electrical connector assembly of claim 16 wherein said latch arm includes a plurality of latching serrations engageable by edges of said latching plate.

18. The electrical connector assembly of claim 12 wherein said second means includes means for latching the connector assembly to a complementary mating connector at said second side of the panel.

19. The electrical connector assembly of claim 18 wherein said second means comprise a latch arm projecting from the multi-function component through the panel, said means for latching being engageable with the latch arm, and said means for locking comprising a latching aperture in the latch arm.

20. An electrical connector assembly for mounting to a first side of a panel and through an opening in the panel, comprising;

a connector housing adapted for mounting through the opening in the panel and carrying a plurality of terminals; and a multi-function mounting/latch component having first means for mounting the connector housing to said multi-function component at said first side of the panel and through the opening in the panel, second means for mounting the connector housing to said multi-function component, and third means for mounting extending through the opening to a second side of the panel, and engageable with means for locking the connector assembly to the panel at said second side of the panel to hold the connector assembly to the panel, the third means further including means for latching the connector assembly to a complementary mating connector at said second side of the panel.

21. The electrical connector assembly of claim 20 wherein said second means for mounting comprise a latch arm projecting from the multi-function component through the panel, said means for locking being engageable with the latch arm, and said means for latching comprise a latching aperture in the latch arm.

22. The electrical connector assembly of claim 20 wherein said first means for mounting comprise at least one mounting post on the housing insertable into a mounting aperture in the multi-function component.

23. The electrical connector assembly of claim 22 wherein said first means for mounting comprise a plurality of said mounting posts on the housing insertable into a corresponding plurality of mounting apertures in the multi-function component.

24. The electrical connector assembly of claim 20 wherein said second means for mounting comprise a latch arm projecting from the multi-function component through the panel, said means for locking being engageable with the latch arm.

25. The electrical connector assembly of claim 24 wherein said latch arm includes a plurality of latching serrations engageable by said means for locking to accommodate panels of varying thicknesses.

26. The electrical connector assembly of claim 24 wherein said multi-function component is elongated and includes a pair of said latch arms at opposite ends thereof.

27. The electrical connector assembly of claim 24 wherein said means for locking include a thin locking plate engageable with the latch arm.

28. The electrical connector assembly of claim 27 wherein said latch arm includes a plurality of latching serrations engageable by edges of said locking plate.

* * * * *